US006733108B2

(12) United States Patent
Barton et al.

(10) Patent No.: US 6,733,108 B2
(45) Date of Patent: May 11, 2004

(54) SPILL RESISTANT SPITTOON FOR PRINTER SERVICE STATIONS

(75) Inventors: E. Lewis Barton, Corvallis, OR (US); Antonio Monclus, Castelldefels Barcelona (ES); Macia Sole, Sant Cugat del Valles Barcelona (ES); Lluis Hierro, Sant Llorenc d'Hortons Barcelona (ES)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

(21) Appl. No.: 10/066,216

(22) Filed: Jan. 31, 2002

(65) Prior Publication Data

US 2003/0142150 A1 Jul. 31, 2003

(51) Int. Cl.[7] ..... B41J 2/185
(52) U.S. Cl. ..... 347/36
(58) Field of Search ..... 347/36

(56) References Cited

U.S. PATENT DOCUMENTS

| | | | | |
|---|---|---|---|---|
| 5,563,639 | A | 10/1996 | Caimeron et al. | |
| 5,602,577 | A | 2/1997 | Shibata et al. | |
| 5,614,930 | A | 3/1997 | Osborne et al. | |
| 5,617,125 | A | 4/1997 | Chew | |
| 5,659,342 | A | 8/1997 | Lund et al. | |
| 5,742,303 | A | 4/1998 | Taylor et al. | |
| 5,757,395 | A | 5/1998 | Chew et al. | |
| 5,886,714 | A | 3/1999 | Burney et al. | |
| 5,980,018 | A | 11/1999 | Taylor et al. | |
| 5,984,450 | A | 11/1999 | Becker et al. | |
| 5,997,128 | A | 12/1999 | Lou et al. | |
| 6,042,216 | A | 3/2000 | Garcia et al. | |
| 6,050,671 | A | 4/2000 | Rotering | |
| 6,132,026 | A | 10/2000 | Taylor et al. | |
| 6,135,585 | A | 10/2000 | Johnson et al. | |
| 6,155,667 | A | 12/2000 | Eckard et al. | |
| 6,168,258 | B1 | 1/2001 | Lou et al. | |
| 6,203,137 | B1 * | 3/2001 | Niimura et al. | 347/36 |
| 6,213,583 | B1 | 4/2001 | Therien | |
| 6,224,186 | B1 | 5/2001 | Johnson et al. | |
| 6,247,783 | B1 | 6/2001 | Shibata et al. | |
| 6,318,838 | B1 | 11/2001 | Anderson et al. | |
| 6,340,220 | B1 | 1/2002 | Gaylor et al. | |

FOREIGN PATENT DOCUMENTS

| | | | |
|---|---|---|---|
| EP | 0841175 A2 * | 5/1998 | B41J/2/185 |

* cited by examiner

*Primary Examiner*—Huan Tran

(57) ABSTRACT

A spittoon for servicing an inkjet printhead is provided, where the spittoon includes a bottom and one or more walls. At least one wall of the spittoon has an inwardly extending lip. The walls of the spittoon, taken in combination with the bottom of the spittoon, define a waste ink reservoir. The presence of at least one lip on the spittoon walls helps retain the waste ink when the spittoon is moved or tilted, minimizing ink spills.

12 Claims, 2 Drawing Sheets

Fig. 4
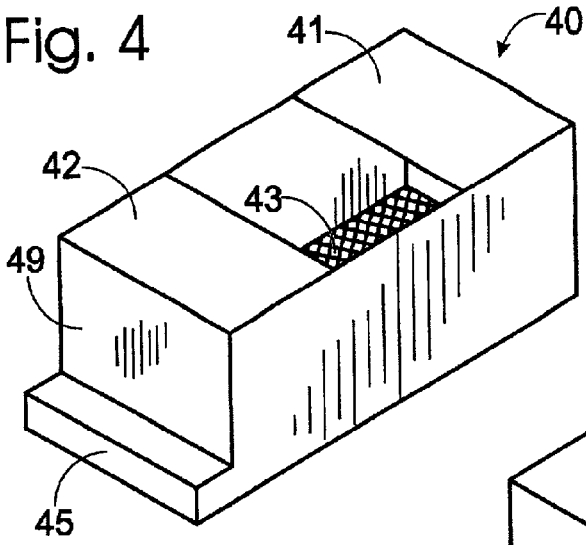
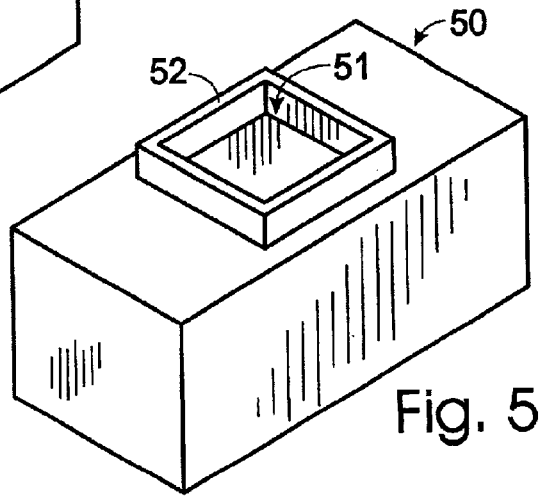
Fig. 5
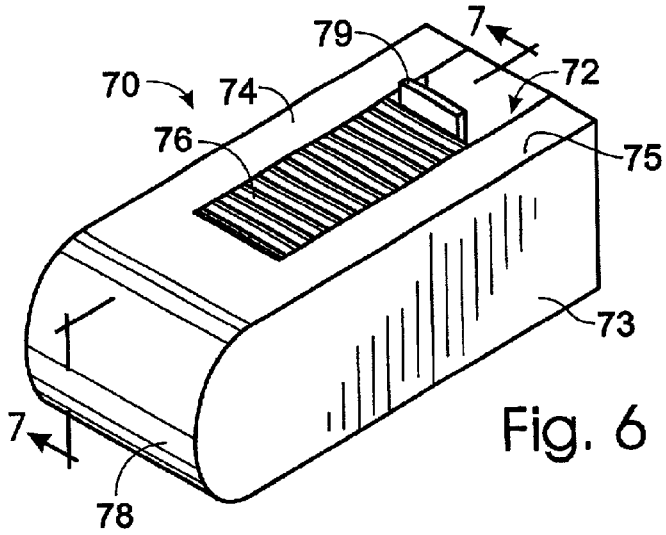
Fig. 6
Fig. 7
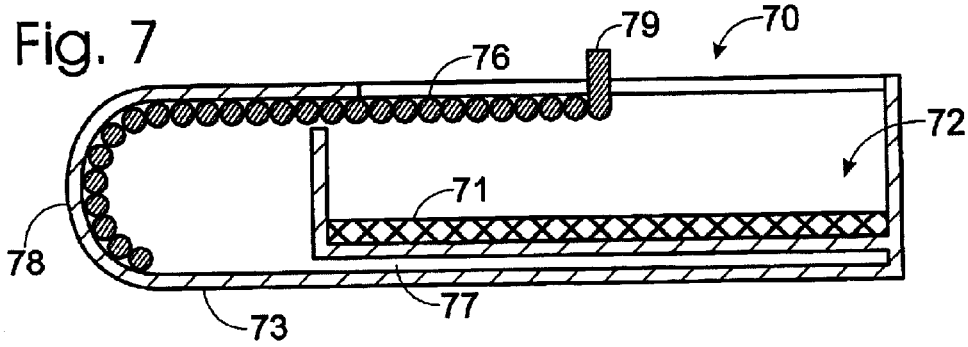

SPILL RESISTANT SPITTOON FOR PRINTER SERVICE STATIONS

FIELD OF THE INVENTION

The invention relates generally to printing mechanisms, and more particularly to an improved spittoon for receiving and storing waste ink ejected during printhead servicing.

BACKGROUND OF THE INVENTION

Inkjet printing mechanisms generally include one or more pens that eject small drops of liquid colorant, generally referred to herein as "ink," onto a print media. Each pen has a printhead that incorporates very small nozzles through which the ink drops are fired. When the ink nozzles become obstructed or blocked, the print quality of the printer is degraded. The printhead must therefore occasionally be serviced. Printhead nozzles are typically cleared by firing a number of drops of ink through each of the nozzles in a process known as "spitting." This waste ink is generally collected in a waste ink reservoir that is typically part of a printhead service station. The waste ink reservoir is often referred to as a "spittoon."

Earlier spittoon designs feature substantially straight spittoon walls and open spittoon tops. Even if a spittoon is partially enclosed with a bonnet, the joint between the spittoon base and the bonnet is not liquid-tight, and leaks if the liquid level reaches the joint. If a printer containing such a spittoon is tipped or moved while the spittoon contains a substantial volume of liquid waste ink, the waste ink can leak into the interior of the printer, or even onto the operator or the operator's belongings. The potential for spilling the waste ink also exists whenever the spittoon is emptied or replaced, even when the printer itself remains stationary and level.

SUMMARY OF THE INVENTION

A spittoon for servicing a printhead is provided, where the spittoon includes a reservoir for waste ink, and incorporates a precipitating agent within the reservoir, wherein the precipitating agent is selected to react with a component of the waste ink to form a precipitate. At least one wall of the spittoon has an inwardly extending lip, so that the spittoon may be tilted without spilling the waste ink.

BRIEF DESCRIPTION OF THE DRAWINGS

FIG. 4 is an isometric view of a spittoon according to another alternate embodiment of the invention.

FIG. 5 is an isometric view of a spittoon according to another alternate embodiment of the invention.

FIG. 6 is an isometric view of a spittoon according to another alternate embodiment of the invention.

FIG. 7 is a cutaway side view of the spittoon of FIG. 6 taken along line 7—7 of FIG. 6.

DETAILED DESCRIPTION

Figure 1:
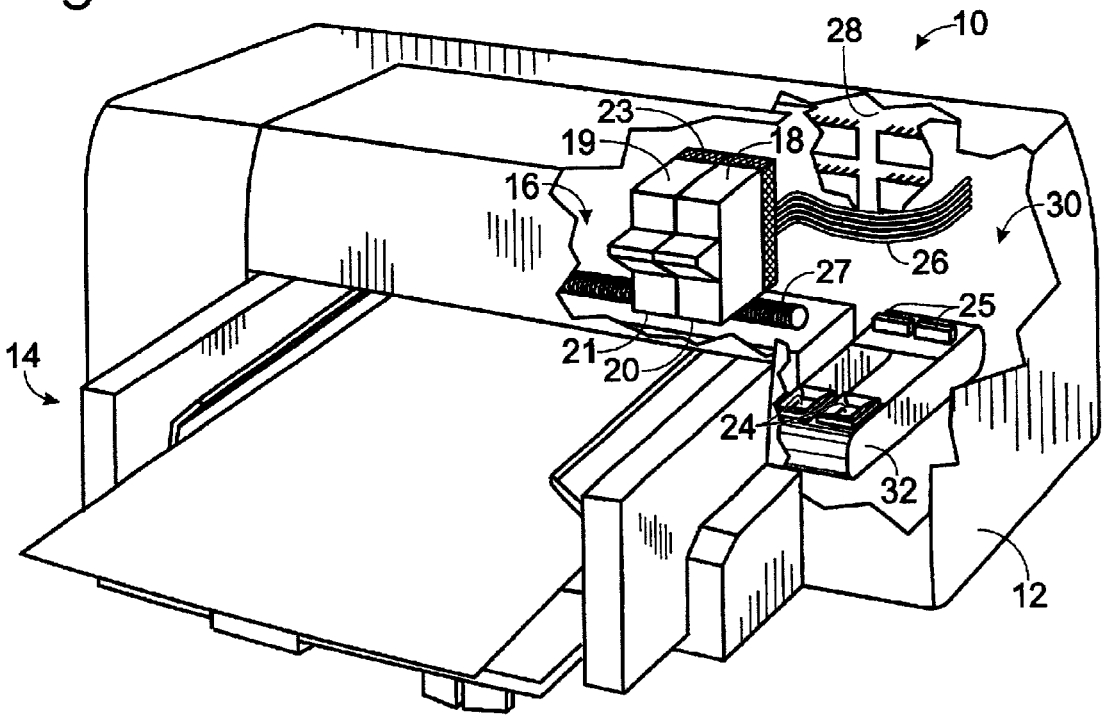
FIG. 1 is an isometric view of an inkjet printing mechanism, here for the purposes of illustration shown as a printer incorporating a spittoon formed in accordance with one embodiment of the present invention.

FIG. 1 shows a hardcopy device, here for the purposes of illustration shown as an inkjet printer 10, constructed in accordance with an illustrated embodiment of the present invention. The printer 10 includes a chassis 12, and a print media handling system 14, for supplying sheets of print media to the printer 10. Although the print media may be any type of suitable material, such as paper, card stock, transparencies, MYLAR films, foils, and the like, for the purposes of illustration, the embodiment of FIG. 1 is described as using paper sheets as the print media. The print media handling system 14 moves the print media into and out of a print zone 16, where ink is applied to the print media by one or more inkjet cartridges 18 and 19. Cartridges 18, 19 may also be referred to as "pens." In the illustrated embodiment, cartridge 18 is a black ink cartridge, and cartridge 19 applies three dye-based ink colors, such as cyan, yellow, and magenta. It should be apparent that more or fewer ink cartridges may be used, and that individual cartridges may be used for each color of ink. Further, the inks may be dye-based, pigment-based, paraffin-based, or hybrids or composites thereof.

Each of cartridges 18 and 19 have printheads 20 and 21, respectively. Each printhead has a bottom surface defining an array of ink nozzles (not shown). The ink nozzles may utilize any mechanism for ejecting individual droplets of ink onto the print media, including thermal mechanisms using resistive heating with accompanying bubble formation, or piezoelectric mechanisms.

Cartridges 18 and 19 are typically transported by a printer carriage 23 that is driven by any conventional drive mechanism along a guide rod 27. Guide rod 27 defines a scanning direction for printer carriage 23 over print zone 16. Ink is deposited by pens 18 and 19 at a particular location on the print media by the accurate coordination of the print media handling system, the movement of the printer carriage, and the activation of the printheads 20, 21, all controlled by a printer controller 28 via a connecter 26. Although the printer controller 28 is depicted as a microprocessor within the printer, the actual printer controller may be contained within the printer itself, or may be resident in an external device, such as a personal computer.

Inkjet printer 10 also includes a printhead service station 30, located at one end of the travel path of the printer carriage on guide rod 27. Typically the printhead service station is mounted within the printer chassis, and in addition to an ink spittoon may also include a pen capping system to protect the printhead nozzles from contaminants and drying, and/or a printhead wiper typically made from an elastomeric material for removing ink residue, dust, and debris from the printhead. Printhead service station 30 includes a spittoon 32 constructed according to an illustrated embodiment of the present invention. The service station 30 may also include one or more conventional inkjet pen caps 24 for black or color pens, and one or more wipers 25 for the black and color printheads, all moveable into servicing positions of printhead engagement.

A variety of inks are available for inkjet printing including dye-based inks, pigment-based inks, polymer or wax based inks, and mutually precipitating inks developed to enhance color contrast. Most or all of these inks, however, still deliver at least some liquid waste ink components to the spittoon during printhead cleaning. Although a variety of techniques have been utilized to speed evaporation of liquids from the waste ink in the spittoon, such as absorbent foam pads within the spittoon. Absorbent foam pads in a spittoon speed evaporation by providing more surface area over which the ink spreads through capillary action. Still, the spittoon for a given printer may accumulate a substantial amount of liquid waste ink, particularly if the printer is subject to a high volume of printing over a short time.

Figure 2:
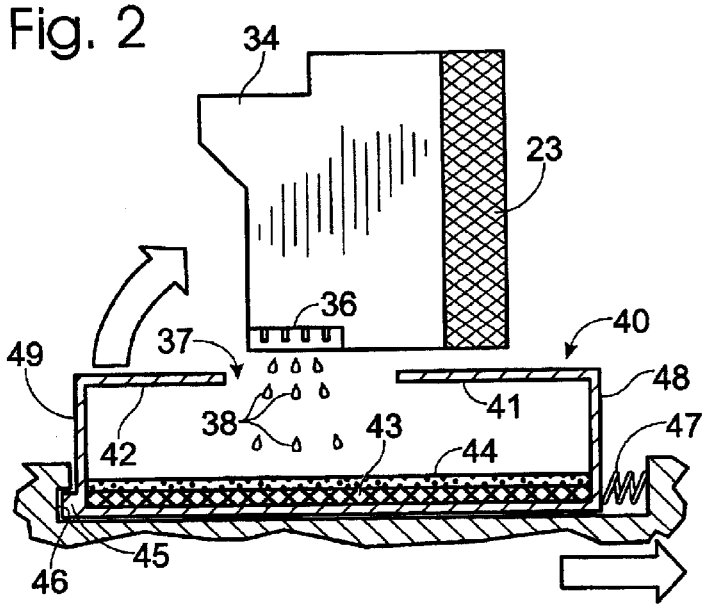
FIG. 2 is a side view of an inkjet pen ejecting waste ink into a spittoon of the present invention formed in accordance with an alternate embodiment.

FIG. 2 shows a pen 34, including a printhead 36, ejecting ink 38 into a first embodiment of spittoon 32, here shown as spittoon 40 according to an illustrated embodiment of the present invention. The droplets of ejected ink 38 accumulate over time in the spittoon to yield a quantity or supply of waste ink 44. Spittoon 40 includes inwardly extending lips 41 and 42 that help contain the waste ink within the spittoon. Lips 41 and 42 also help to contain aerosol particles of ejected ink that might otherwise contaminate the interior of the printer, degrading the printer performance and potentially transferring to the print media or the operator's fingers.

Lips 41 and 42 typically meet the top edge of walls 48 and 49, respectively, and extend to join each of a pair of opposing side walls that connect walls 48 and 49, forming a waste ink reservoir In an alternative embodiment, the inwardly extending lips meet the top edges of the walls with a curving interface, so as to effectively function as a wrap-around extension of the walls themselves, as shown in FIG. 1.

The spittoon may have only one inwardly extending lip, or two or more inwardly extending lips, typically at the tops of opposing walls of the spittoon. In one embodiment of the invention, the spittoon has inwardly extending lips at the tops of four walls, the four walls including two pairs of opposing walls, thereby defining a spittoon entrance.

The spittoon may further incorporate within the waste ink reservoir a precipitating agent. The precipitating agent is a compound that is selected so as to chemically react with one or more components of the waste ink and form a precipitate. A selected precipitating agent may be specific for a single ink formulation, or type of ink formulation, and the spittoon may include a plurality of distinct precipitating agents. Typically, the precipitating agent is a salt of a multivalent cation, or a multivalent organic acid. In one embodiment of the invention, the precipitating agent is a salt of a multivalent cation that is a calcium salt, an aluminum salt, a tin salt, a copper salt, or an iron salt. In another embodiment of the invention, the precipitating agent is a multivalent organic acid that is citric acid, succinic acid, or salicylic acid In yet another embodiment of the invention, the precipitating agent includes one or more of calcium nitrate, magnesium nitrate, aluminum chloride, calcium chloride, tin chloride, copper chloride, ferric chloride. Preferably, the precipitating agent includes calcium nitrate, magnesium nitrate, or both. The precipitating agent is optionally incorporated within the reservoir in an absorbent pad 43, typically at the bottom of the spittoon, that serves to absorb the liquid in collected waste ink and hasten evaporation of volatile ink components.

The spittoon is typically held in a fixed position by a retaining mechanism, so that the print processor is able to reproducibly orient the printhead over the mouth of the spittoon and accurately spit waste ink into the spittoon. In another embodiment of the invention, the spittoon is retained by a moveable mechanism, so that the print processor can orient the printhead over the mouth of the spittoon by moving the spittoon, or by using a combination of movement of the printer carriage and movement of the spittoon.

The spittoon 40 is typically securely held in place in the printer, but can be readily removed in order to empty or replace the spittoon. A number of suitable retention mechanisms may be used to secure the spittoon, including elastic bands, latches, screws, adhesives, and the like. In the embodiment depicted in FIG. 2, the spittoon is held in place by a detent arrangement. Spittoon 40 of FIG. 2 thus incorporates a retaining member, such as tab 45 that fits within a niche 46 defined by the body of the printer. Tab 45 is biased against niche 46 by a spring 47. In order to remove the spittoon, spring 47 is compressed such that tab 45 may clear niche 46. The motion of spittoon 40 when removed is indicated by the arrows of FIG. 2. Where spittoon 40 must be tipped or tilted, such as when it is being removed from the printer, it is preferably tipped toward a spittoon wall that features an inwardly extending lip, such as lip 41.

Figure 3:
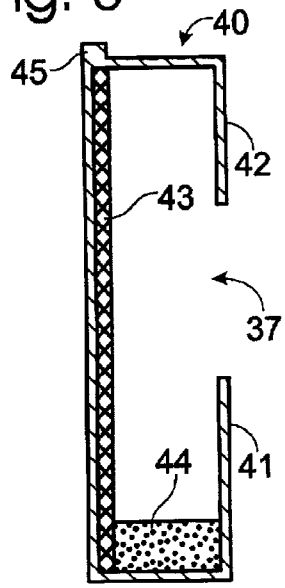
FIG. 3 is a fragmented side view of the spittoon of FIG. 2 rotated ninety degrees, showing how waste ink is retained within the spittoon.

Although such extreme rotation is typically not required to remove the spittoon from the service station, in one embodiment of the invention, lip 41 extends sufficiently far that when the spittoon is tilted toward the lip at an angle of up to approximately ninety degrees, the spittoon can retain, without spilling, a volume of waste ink equal to approximately one-quarter of the total capacity of the spittoon when level. This situation is depicted in FIG. 3, where spittoon 40 is tipped toward lip 41 at an angle of approximately 90 degrees. Waste ink 44 is retained by lip 41, and prevented from spilling outside the spittoon. In another embodiment of the invention, a spittoon lip extends inwardly sufficiently far that when the spittoon is tilted toward the lip at an angle of up to approximately forty-five degrees, the spittoon can retain, without spilling, a volume of waste ink equal to approximately one-half of the total capacity of the spittoon when level.

In another illustrated embodiment of the invention, the printer 10 incorporates a drop or pen counter that tracks the usage of the printhead or printheads or the number of cartridge replacements, so that a user may be alerted that the spittoon should be cleaned or replaced before it becomes full. The drop or pen counter may be use-rate sensitive, so that where use rate is sufficiently low that the normal evaporation of ink volatiles from the spittoon should prevent the spittoon from overflowing, the printer user is not alerted. Alternate embodiments may use sensors to monitor the liquid level of ink in the spittoon, such as an optical sensor.

As shown in FIG. 4, in one embodiment of the invention, the spittoon may have inwardly extending lips at the top edges of two opposing spittoon walls. Alternatively, as shown in FIG. 5, the spittoon of the invention may have four walls, each wall having an inwardly extending lip that defines a spittoon mouth 51. The spittoon mouth may be flush with the lips, or may incorporate a raised edge 52 around all or a portion of the spittoon mouth.

As the spittoon is typically incorporated in an inkjet printer, the dimensions of the spittoon are selected so that it fits readily within the chassis of the printer, and can be removed and/or replaced. In one embodiment, the distance between a pair of opposing spittoon walls is from approximately two centimeters to approximately twelve centimeters. In another embodiment, the distance between opposing walls is from approximately three centimeters to approximately ten centimeters.

The spittoon 32 may further include a removable or retractable lid that also helps retain waste ink within the spittoon, as shown for spittoon 70 in FIGS. 6 and 7. By using a fully covered spittoon, a printer operator may avoid any exposure to waste ink, or to foam pads that are saturated with waste ink.

Spittoon 70 incorporates a flexible lid or cover that hides below or within the spittoon when open. Spittoon 70 incorporates an inner ink reservoir 72 that includes an absorbent pad 71. The spittoon is surrounded by an outer case 73 that incorporates one or more lips 74 and 75 to help retain waste ink and ink aerosol, as described above. The spittoon further includes a flexible lid 76 covers the opening between lips 74 and 75. The lid 76 can be opened by sliding it between the inner reservoir 72 and outer case 73. When closed, lid 76 covers the opening between lips 74 and 75. When opened, lid 76 may be hidden beneath inner reservoir 72 in a gap 77 between the reservoir and outer case 72. Spittoon 70 incorporates a rounded end 78 that serves to provide a smooth surface along which lid 76 can slide.

Typically, spittoon 70 would be received in a closed configuration by the printer user, who could in turn install the spittoon without opening it. The printer itself could open the lid of the spittoon, and either keep the lid open throughout its operation lifetime, or open the lid as needed in order to spit ink into the inner reservoir, for example, by utilizing a flexible flange (not shown), such as a clip, a spring, or an elastomeric rib attached to the printer chassis in the printhead service station area to open and close the spittoon lid.

After spittoon 70 is inserted into the printer service station 30, the printer may move the spittoon into an appropriate position, urging the flange against a rib 79 on the lid of the spittoon, thereby opening the spittoon. Once the spittoon is opened, the flange may flex, permitting the entire spittoon module to pass beneath it. The spittoon, now open, may be seated in the appropriate working position until it needs to be replaced with a fresh spittoon.

To replace the spittoon, the service station carriage may move the flange in the opposite direction, urging the lid rib in the opposite direction to close the spittoon. The closed spittoon may then be removed and disposed of by the user, without permitting the waste ink within the reservoir to be spilled. As discussed above, a drop counter or pen counter may be used to determine when the spittoon should be replaced.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances which fall within the scope of the appended claims.

What is claimed is:

1. A spittoon for servicing a printhead, the spittoon comprising:

a bottom;

one or more walls, each wall having a top edge, the walls in combination with the bottom defining a waste ink reservoir having a capacity;

an inwardly extending lip at the top edge of at least one wall configured to retain a volume of waste ink when the spittoon is tilted toward the lip; and a retractable lid which, when retracted, is enclosed in a portion of the spittoon that is distinct from the waste ink reservoir.

2. The spittoon of claim 1, wherein the lip extends inwardly around an upper perimeter of the spittoon and defines a spittoon entrance.

3. The spittoon of claim 1, further comprising a precipitating agent within the reservoir, wherein the precipitating agent is a salt of a multivalent cation or a multivalent organic acid.

4. The spittoon of claim 3, wherein the precipitating agent is incorporated in an absorbent pad within the reservoir.

5. The spittoon of claim 3, wherein the precipitating agent is calcium nitrate or magnesium nitrate.

6. A spittoon for servicing a printhead, the spittoon comprising:

a bottom;

one or more walls, each wall having a top edge, the walls in combination with the bottom defining a waste ink reservoir having a capacity;

an inwardly extending lip at the top edge of at least one wall configured to retain a volume of waste ink when the spittoon is tilted toward the lip; and where the reservoir is configured such that when the spittoon is tilted toward the lip at an angle up to ninety degrees, the lip retains a volume of waste ink equal to approximately one-quarter of the capacity of the waste ink reservoir.

7. A spittoon for servicing a printhead, the spittoon comprising:

a bottom;

one or more walls, each wall having a top edge, the walls in combination with the bottom defining a waste ink reservoir having a capacity;

an inwardly extending lip at the top edge of at least one wall configured to retain a volume of waste ink when the spittoon is tilted toward the lip; and where the reservoir is configured such that when the spittoon is tilted toward the lip at an angle up to forty-five degrees, the lip retains a volume of waste ink equal to approximately one-half of the capacity of the waste ink reservoir.

8. An inkjet printing mechanism, comprising:

means for spitting ink into a spittoon;

means for retaining said previously spit ink within said spittoon during tilting of gold inkjet printing mechanism at an angle of up to 45 degrees; and means within said spittoon for initiating a precipitation reaction with at least one component of said previously spit ink.

9. A method of utilizing a spittoon in an inkjet printing mechanism, comprising:

spitting ink into the spittoon positioned in a spit orientation;

accumulating a supply of ink in said spittoon;

precipitating at least one component of said ink in said spittoon;

removing said spittoon with said supply from the inkjet printing mechanism;

during said removing, tilting said spittoon from said spit orientation; and during said tilting, retaining said supply within said spittoon.

10. The method of claim 9, wherein said spittoon is tilted at up to 90 degrees.

11. The method of claim 9, wherein said spittoon is tilted in more then one direction.

12. The method of claim 9, further comprising dumping said supply and replacing said spittoon in said inkjet printing mechanism.

* * * * *